United States Patent [19]

Doerr

[11] 4,415,207

[45] Nov. 15, 1983

[54] UNDERSPOIL SLURRY HAULAGE

[75] Inventor: Richard E. Doerr, Morgantown, W. Va.

[73] Assignee: Conoco Inc., Ponca City, Okla.

[21] Appl. No.: 289,882

[22] Filed: Aug. 4, 1981

Related U.S. Application Data

[63] Continuation-in-part of Ser. No. 103,319, Dec. 14, 1979, Pat. No. 4,286,822.

[51] Int. Cl.[3] ..... E21C 41/04

[52] U.S. Cl. ..... 299/18; 405/179

[58] Field of Search ..... 299/18, 19; 405/179

[56] References Cited

U.S. PATENT DOCUMENTS 4,116,014 9/1978 Satterwhite ..... 405/179

4,143,922 3/1979 Sweeney ..... 299/18

*Primary Examiner*—Ernest R. Purser

*Attorney, Agent, or Firm*—William J. Miller

[57] ABSTRACT

An improved mining method for a surface mine has pairs of slurry and water pipes placed from a processing area on the surface to the floor of the mine beneath the mined out material, pairs of pipes (slurry and water) are spaced along the mining trench. A slurry haulage system is connected to the water and slurry pipes at the beginning of the mining operation. As the mining progresses and the haulage system reaches its maximum capabilites, it is disconnected and connected to the next set of pipes and the first set or pair of pipes is extended the width of the mined trench. The overburden is placed on top of the pipes as the mining progresses.

5 Claims, 4 Drawing Figures

UNDERSPOIL SLURRY HAULAGE

CROSS-REFERENCE TO RELATED APPLICATION

The present application is a continuation-in-part of U.S. Ser. No. 103,319 as filed on Dec. 14, 1979, now U.S. Pat. No. 4,286,822 issued Sept. 1, 1981 and entitled "Underspoil Slurry Haulage".

BACKGROUND OF THE INVENTION

Hauling of material from a surface mine has always posed a problem. Normally, trucks are used but the use of trucks leads to the construction of extensive roadways which results in minerals being left under the road. Furthermore, roads are expensive to build and maintain. Several systems have been proposed to eliminate the use of roads such as, for example, underspoil conveyors and underspoil truck haulage systems. Such systems are described in an article appearing in the publication "Coal Age", April 1976, pages 116–125. One problem, however, with both of the above systems is the extensive tunneling that must be constructed in order to support a pathway for trucks or a sheltered enclosure for a conveyor. Furthermore, such systems require ventilation since men and machines will be inside the tunnels. In the case of a truck of conveyor breakdown the entire passageway may be plugged for an extensive period of time necessitating the closure of the mine during that period of time.

BRIEF DESCRIPTION OF THE INVENTION

This invention discloses a unique use of a slurry haulage system wherein the slurry pipes are placed from the surface to the bed where the mineral has been removed. As mining progresses the slurry pipes are covered by the overburden. Several slurry pipes which include both water and slurry pipes are laid in pairs and spaced along the strip or trench being mined. When the slurry haulage system reaches the maximum length it can extend, it is disconnected and reconnected to the next adjacent pair of pipes. The previous pipes are then extended across the trench and temporarily plugged. As each set of pipes is used and disconnected it likewise is extended across the trench previously mined. When a new trench adjacent the old trench is begun to be mined, the first set of slurry pipes is uncovered and the slurry haulage system connected to it. The mining then progresses as it did with the first trench. When the mining is completed, the slurry pipes are abandoned with only the surface connection being filled and plugged for safety purposes. The remainder of the pipe is well beneath the ground and should pose no hazard environmentally.

DETAILED DESCRIPTION OF THE INVENTION

Figures 1, 2:
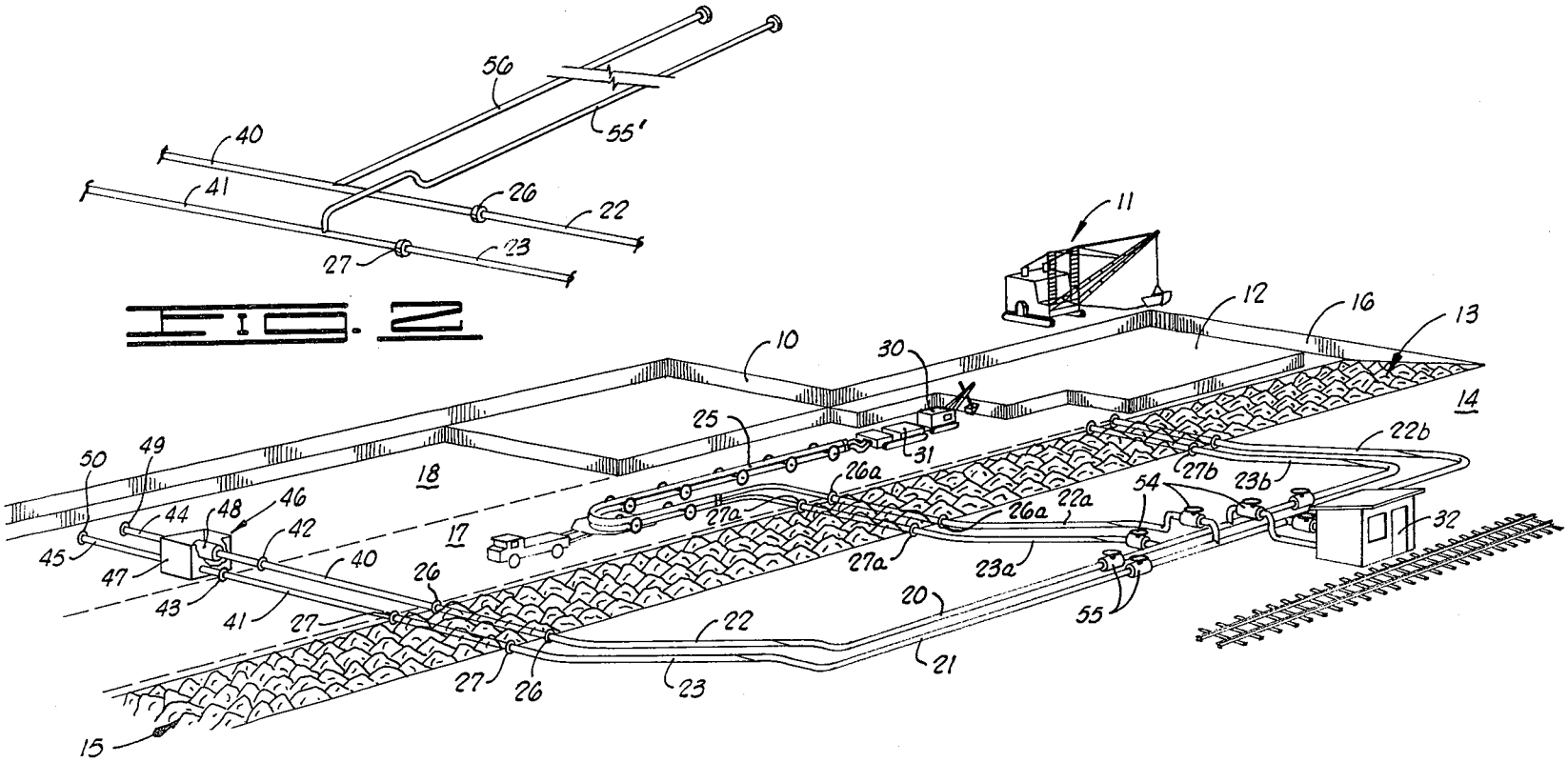
FIG. 1 shows a surface mining layout in the process of being mined with a slurry haulage system illustrating the invention and FIG. 2 shows an alternate method for connecting the slurry pipes illustrated in FIG. 1.

Referring to all the figures, but in particular to FIG. 1, a surface mine is shown with part of the overburden removed and with the slurry pipes positioned in accordance with the invention. The overburden 10 is generally removed by a drag shovel 11 down to a mineral deposit 12 which is being mined for purposes which may, for example, be coal; however, other minerals near the surface could be mined in precisely the same manner. Generally in a mine of this type a first trench referred to by arrow 13 is dug by removing the overburden and depositing it on the ground at a location such as 14. The mine generally progresses in the direction of arrow 15 in the embodiment illustrated. Once the mining has progressed to face 16 a second strip or trench 17 is commensed. For illustrative purposes in describing the invention, a third strip 18 is illustrated as mined. Normally, however, 18 would not be mined until strip 17 is completed. The invention, however, is not limited to mining in single strips and is quite adaptable to more than one strip being mined at a time if the overburden can be properly disposed of in the interim. Normally once strip 13 is mined out bulldozers or other similar equipment will move the overburden onto the mined out area as illustrated so that reclamation of the land can progress. As described in the prior art, the mineral is generally removed by trucks and hauled to a disposal area for shipment or further processing such as washing, cleaning and separating of the coal from shale or other unburnable elements. Such processing is clearly known in the prior art and will not be further discussed.

In order to carry out the features of this invention, a pair of slurry pipes 20 and 21 are laid along the surface of the earth until a point where the pipes 22 and 23 are buried into the ground and sloping down to the floor of the mineral being mined. An area large enough to accommodate a slurry haulage system 25 is mined out and the system installed on the floor of the mine. Normally the haulage system would be connected to the terminous 26 and 27 of pipes 20 and 21, respectively. The slurry haulage system useful in the carrying out of this invention is well-known and already described in U.S. Pat. No. 3,941,425 entitled "Mobile Slurry Handling System" by Eric H. Reichl. The mineral 12 is normally mined by a shovel 30 and deposited in a slurry hopper system 31 where the mineral is sized and mixed with water which is then pumped through one of the pipes 22 or 23 to a processing area 32 whereas in the prior art the coal is separated from the water and the coal processed in the usual manner. The water is returned to the mine and reused to form a slurry at hopper 31. Hopper 31 is also well-known and completely described in U.S. Pat. No. 3,931,936 entitled "Apparatus for Crushing Solids in a Liquid Medium" by Eston F. Petry and Ronald W. Umphrey. Once mining has progressed past the point where the haulage system can extend it will be disconnected from the terminations 26 and 27 of pipes 22 and 23 and connected to pipes **22*a* 23*a* at their terminous 26*a* and 27*a* as is illustrated in FIG. 1. Additional pipes 22*b* and 23*b* which have previously been laid will be utilized once the slurry haulage system has progressed to the point where it is fully extended. Once the slurry haulage system 25 is disconnected from the terminations 26 and 27 of pipes 22 and 23, extensions 40 and 41 are added to pipes 22 and 23, respectively, to the edge of the mined out section 17. Thus pipe extensions 40 and 41 would terminate at locations 42 and 43, respectively. The surrounding area around and over the pipes can be filled in with overburden as is illustrated in the previous strip 13. Continued mining such as strip 18 will result in added sections or extensions 44 and 45 to pipes 40 and 41, respectively. As the extensions are added it becomes necessary to boost the pressure in the pipes. To accomplish this, a boosting station generally referred to by arrow 46 can be set on the floor of the mined out area and, as illustrated in FIG. 1, may be a cement box 47. It could also be a circular metal enclosure or any suitable enclosure having strength sufficient to be surrounded by dirt and rock once the overburden is dumped around it. A suitable booster pump 48 can be mounted at the bottom of enclosure 47 of if desired the pipes can be extended to the top of the enclosure and the booster pump placed on the surface. As previously mentioned, pipes 44 and 45 will have some form of caps or closures 49 and 50, respectively, to prevent dirt, etc. from entering the pipe until a new strip is being cut. Suitable valves 54 and 55** can be incorporated to selectively operate whichever pipe is currently being utilized.

Referring to FIG. 2 an alternate method is shown instead of adding pipes 22*a* and 23*a*, a pair of pipes 55' and 56 can be added to pipes 22 and 23 and these pipes can be extended in the direction that the mining is progressing so that as the haulage system reaches the full distance it can be extended, sections 55' and 56 can be added having a length equal to the spacing between pipes 22 and 22*a*. Extensions 40 and 41 would similarly be added so that overburden could be placed on top of the slurry pipes. The system illustrated in FIG. 2 has a disadvantage that longer runs will be required for the slurry piping. Furthermore, additional bends or elbows will be required which normally have a higher wear problem. Also additional boosters will be required due to the additional length of the slurry piping system.

Once the area being mined is completed the booster pumps such as booster pump 48 is removed and the enclosure filled with dirt. Pipes 22 and 23 may be cut off below the surface and filled rendering the system compatible with most requirements for ecology. The above-described system has many advantages over the prior art. Slurry haulage systems are economical and safe. No tunnels are required which pose a problem both to men and equipment. No movement of materials is passing through tunnels which could result in plugging of tunnels in case of accident or stoppage of conveyors or trucks. Once the system is abandoned underspoil tunnels must be filled in in some manner or torn out. The weight of the overburden renders it virtually impossible to salvage the tunnels by removing them; therefore, they must be filled which is itself an expensive undertaking.

Figure 3:
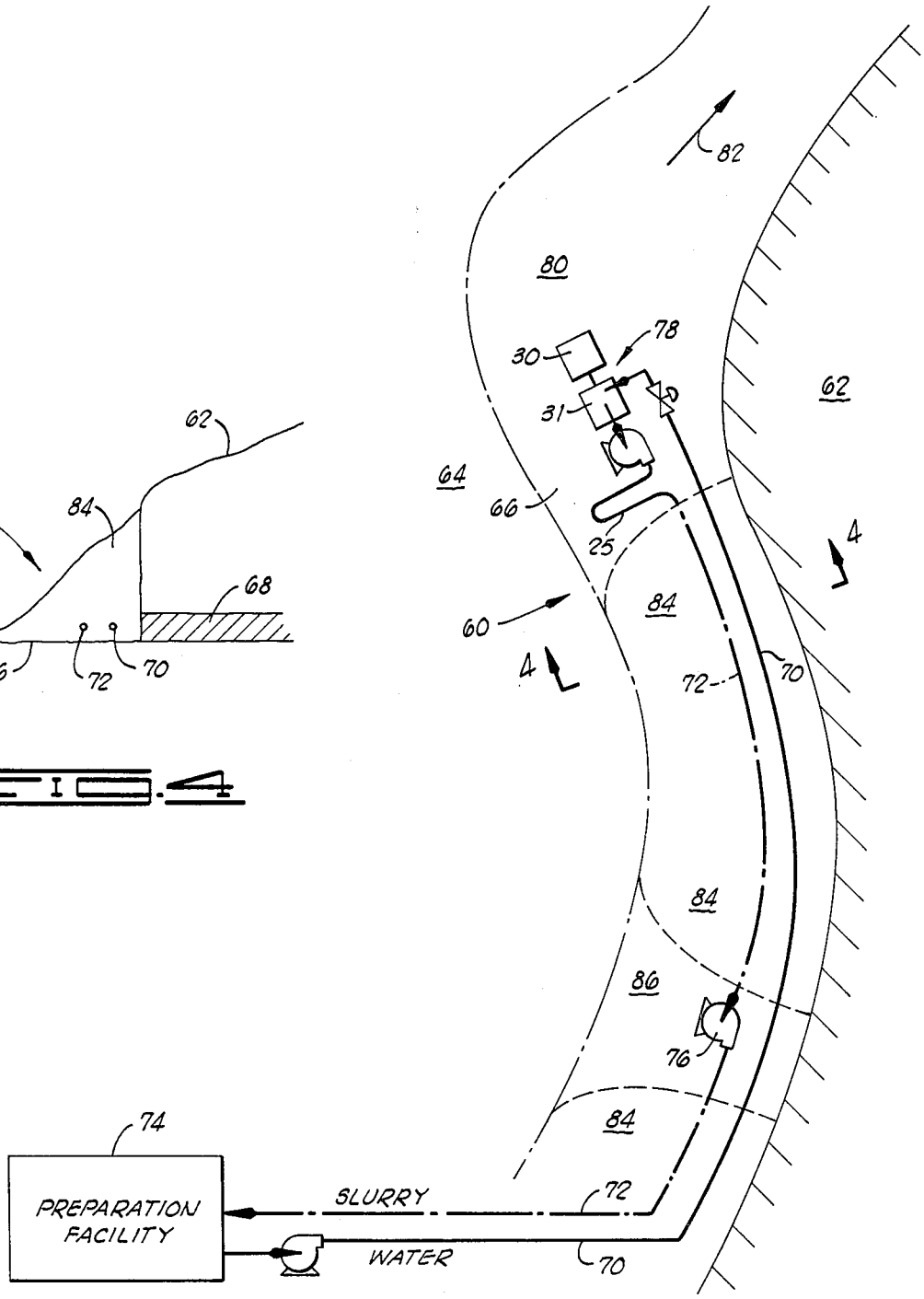
FIG. 3 is a top-plan view in idealized form of a contour mining operation wherein the present invention is utlized.

In some other types of surface mining, the pit or trench does not move in a two-dimensional fashion, but in one direction only. An example of such mining is the contour stripping of coal seams as they may move around a hillside slope. FIG. 3 illustrates such contour seam stripping. Thus, a single pit, trench or bench 60 extends around a mountainside having high ground 62 and downslope lower ground 64.

In present practice, mining around the outcrop coal seam necessitates later reclaiming of the top soil and the subsurface spoil must be moved aside and piled for extended periods. The entire length of the pit or bench floor 66 is exposed for a considerable time as haulage trucks must travel along the bench floor 66 to gain passage around the hill to a designated dump point. After an entire contour length or area is stripped, the spoil and top soil are then replaced and only then is reclamation begun.

The present invention obviates the necessity for the truck haulage as a slurry line is continually laid on bench floor 66 adjacent the high side, and the slurry and water lines are then progressively covered with spoil from the mining operation advance. Such technique serves to greatly reduce the necessity for temporary spoil storage as well as to reduce the need for excessive and repeated soil movement.

Figure 4:
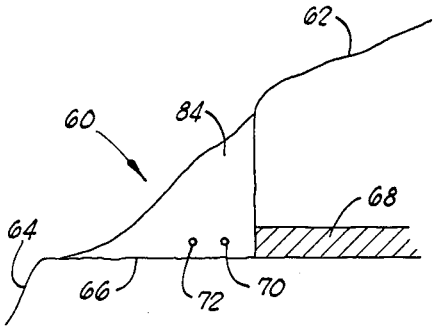
FIG. 4 is a section taken along lines 4—4 of FIG. 3.

As shown also in FIG. 4, a contour stripping bench 60 may proceed around a hillside as mining proceeds through the outcrop portion of a coal seam 68. As the mining machinery proceeds, a water line 70 and slurry line 72 are laid down on the bench floor 66 adjacent the high wall, i.e., toward the higher elevation. The slurry line 72 and water line 70 extend over a selected distance to a preparation facility 74, and booster pumps may be included as needed along the slurry/water lines, depending on the distance of transport. Thus, FIG. 3 illustrates at least one booster pump 76 in slurry line 72.

The mining machinery 78 works in a mining area 80 as the equipment advances in the direction of arrow 82. Mining machinery 78 includes the similar equipment as shown in FIG. 1, i.e., mining machine or shovel 30, slurry hopper system 31 and an extensible slurry haulage system 25 in connection with slurry line 72. As mining machine 78 advances, the spoilage earth 84 is replaced in the bench 60 to essentially fill in the bench cut. More effective top soil replacement can then also be carried out as desired.

It may also be desirable to leave unfilled those areas 86 of bench floor 66 where slurry booster pumps may be located. In such a system, the pipes 70 and 72, deeply buried against the high wall, can be abandoned at the end of the mining strip. The pipes 70 and 72 should be sized in diameter to be thick enough to last for the duration proportional to the amount of coal to be pumped therethrough. Thus, those sections of pipe nearest the preparation facility 74 would have thicker walls to provide optimum operation.

It is obvious that other arrangements of pipes would be required if a different mining system is utilized over that specifically disclosed and the invention is not so limited as to be specific to any particular mining method. It is also obvious that more than one face can be operated at one time and that under these conditions more than one haulage system can be incorporated.

It is obvious that modifications and changes can be made to the invention and still be within the spirit and scope of the invention as disclosed in the specification and appended claims.

The embodiments of the invention in which an exclusive property or priviledge is claimed are defined as follows:

1. A method for underspoil haulage of mineral product from a contour surface mine where a mineral layer outcrops to the earth surface, comprising:

continuously, uni-directionally removing a strip of overburden exposing the outcropped mineral layer and mining the mineral product from said layer;

laying extensibly a slurry pipe and a water pipe from a preparation facility along the mined strip;

slurrying said mined mineral product with water for introduction to said slurry pipe and transport to the preparation facility; and continuously placing the removed overburden material behind the unidirectional advance and covering the slurry pipe and water pipe within the mined strip.

2. A method as set forth in claim 1 wherein:

at least one booster pump is connected along the slurry pipe.

3. A method as set forth in claim 2 wherein:

the mined strip receives no overburden at the point of said booster pump and the pump is left exposed.

4. A method as set forth in claim 1 where:

said mineral layer outcrop is coal.

5. A method as set forth in claim 1 wherein:

said replaced overburden material is continuously graded in conformation with surrounding terrain to provide a reclaimed earth surface.

* * * * *